US006363901B1

(12) United States Patent
Watanabe et al.

(10) Patent No.: US 6,363,901 B1
(45) **Date of Patent: *Apr. 2, 2002**

(54) PULL STARTER FOR ENGINE

(75) Inventors: Kazuhiko Watanabe; Goichi Katayama, both of Shizuoka (JP)

(73) Assignee: Sanshin Kogyo Kabushiki Kaisha (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/170,489

(22) Filed: Oct. 13, 1998

(30) Foreign Application Priority Data

Oct. 13, 1997 (JP) ..... 9-294916

(51) Int. Cl.[7] ..... F02N 3/02

(52) U.S. Cl. ..... 123/185.3; 74/7 C; 74/577 R; 192/42; 192/46

(58) Field of Search ..... 123/185.2, 185.3, 123/185.4; 74/7 C, 577 S, 577 R; 192/42, 46

(56) References Cited

U.S. PATENT DOCUMENTS

| | | | | |
|---|---|---|---|---|
| 3,730,162 A | * | 5/1973 | Murase | 123/185.3 |
| 3,782,355 A | | 1/1974 | Hamman | 123/185.3 |
| 4,359,021 A | * | 11/1982 | Frahm | 123/185.3 |
| 4,426,961 A | | 1/1984 | Grinde | 123/179.26 |
| 4,970,998 A | * | 11/1990 | Tyler | 123/185.3 |
| 5,064,393 A | | 11/1991 | Inoue | 440/77 |
| 5,425,336 A | | 6/1995 | Nakayama | 123/198 R |

FOREIGN PATENT DOCUMENTS

| | | | | |
|---|---|---|---|---|
| GB | 816257 | * | 7/1959 | 123/185.3 |

* cited by examiner

*Primary Examiner*—Andrew M. Dolinar
(74) *Attorney, Agent, or Firm*—Knobbe, Martens, Olson & Bear, LLP

(57) ABSTRACT

An outboard motor has a quieter operating recoil starter arrangement. The recoil starter has a starter drum with a dog clutch arrangement having two dog cam members. The dog cam members rotate between an initial position and an extended position under the influence of a clutch drive member. Specifically, the dog cams each have a portion which engages a starter pulley when a starter rope is pulled. The dog cams are configured to extend minimally into a corresponding slot of the starter pulley when in their extended position. Such configuration results in less chatter when the starter pulley speed exceeds the starter drum speed upon ignition of the engine.

17 Claims, 5 Drawing Sheets

Unpreffered Embodimet

Unpreffered Embodimet

Unpreffered Embodimet

PULL STARTER FOR ENGINE

BACKGROUND OF THE INVENTION

1. Field of the Invention

The present invention generally relates to a starting arrangement for internal combustion engines. In particular, the present invention is an improved starter arrangement for such engines.

2. Description of Related Art

As is well known, many small internal combustion engine applications employ pull-type, or recoil, starters. With reference to FIGS. 7–9, such a starter arrangement will be introduced. Internal combustion engines with recoil starters have a dog cam arrangement in which a dog cam 200 engages a rotatable pulley 210 that is generally affixed to an end of an engine crankshaft. The rotatable pulley has a plurality of web portions that define a corresponding plurality of slots 212. The dog cam 200 is arranged to be pivoted about a shaft 206 and urged into an extended position by a clutch drive member 208 in a known manner.

As a starter cord is pulled, a starter drum, to which the dog cam 200 is attached, rotates and eventually a distal clasp portion 202 of the dog cam 200 engages a slot 212 in the pulley 210. The dog cam 200, thus, couples the starter drum and the pulley 210 together so long as the drum is spinning in the same direction as the pulley 210 and at the same rate. Thus, the two remain coupled until the rotational speed of the pulley exceeds the rotational speed of the drum. The pulley 210, meanwhile, exerts a compressive force on the engine by spinning the crankshaft. By spinning the crankshaft, the internal combustion cycle can be initiated as is known.

Once the engine has started, the pulley 210 will overrun the starter drum. So long as the operator is still rotating the starter drum via the starter rope, the clutch drive member 208 urges the dog cams 200 against the pulley 210. Thus, the clasp portion 202 of the dog cams 200 will bounce in and out of the slots 212 with which they were engaged while the engine was started. A ramping surface 204 that terminates in the clasp portion 202 amplifies the bouncing.

Previously, the ramping surfaces 206 and the clasp portions 202 of the prior dog cams 200 would temporarily clatter against the pulley 210 following an engine start. This condition would result because the pulley 210 was rotating faster under the power of the engine than the starter drum could rotate under the power of the starter cord. Additionally, if the starter drum was still rotating when the engine assumed operation under its own power, the dog cams 200 would remain engaged. Thus, the dog cams would repeatedly beat against the surfaces defining the slots 212 and cause unnecessarily high noise levels and possible undesirable engine component damage over time. The increased noise levels associated with the prior design are also undesirable, in part, due to the adverse impact of engine and vehicle noise on fish and wildlife.

SUMMARY OF THE INVENTION

Accordingly, one aspect of the present invention involves a recoil starter arrangement for an internal combustion engine. The recoil starter arrangement has a starter drum and a clutch drive member frictionally secured to the starter drum. A dog cam is pivotably secured to the starter drum in a location substantially adjacent to the clutch drive member. The dog cam has an external surface, a cam surface, and a ride surface which is interposed between the cam surface and the external surface. The ride surface defines a plane which is skewed relative to the external surface and the cam surface.

Another aspect of the present invention involves a recoil starter arrangement for an internal combustion engine. The recoil starter arrangement has a starter drum. A dog cam is attached to the starter drum by a shaft. The recoil starter arrangement also has a starter pulley. The starter pulley has an internal surface. The dog cam has a cam surface, an external surface and a ride surface interposed therebetween. A means is provided from engaging the dog cam with the starter pulley such that the ride surface of the dog cam selectively contacts the internal surface of the starter pulley.

A further aspect of the present invention involves a recoil starter arrangement for an internal combustion engine. The starter arrangement provides a starter pulley having a segmented inner surface defined at an inner radius. The segmented inner surface having slots defined therein. A dog cam member selectively contacts the segmented inner surface. The dog cam member also has a ride surface which is generally tangential to the inner radius while the dog cam member is in contact with the segmented inner surface.

Yet another aspect of the present invention provides an internal combustion engine having a recoil starting arrangement. The engine has an output shaft and a flywheel attached to the output shaft. A starter pulley is operably connected to the flywheel. The starter pulley has a plurality of engagement grooves separated by web portions. A dog cam is pivotably attached to a starter drum and has an engaging tip portion. The engaging tip portion is selectively engageable with one of the plurality of engagement grooves of the starter pulley. The engaging tip portion is desirably contoured to complement the web portions such that the engaging tip portion can substantially glide over the engaging grooves when the starter pulley rotates in a second direction relative to the starter drum. This arrangement, among others, can reduce a noise level associated with the starter arrangement following ignition.

BRIEF DESCRIPTION OF THE DRAWINGS

These and other features of the invention will now be described with reference to the drawings of a preferred embodiment and a prior design. The drawings of the preferred embodiment are intended to illustrate and not to limit the invention, and the drawings contain the following figures.

DETAILED DESCRIPTION OF THE PREFERRED EMBODIMENT OF THE INVENTION

Figure 1:
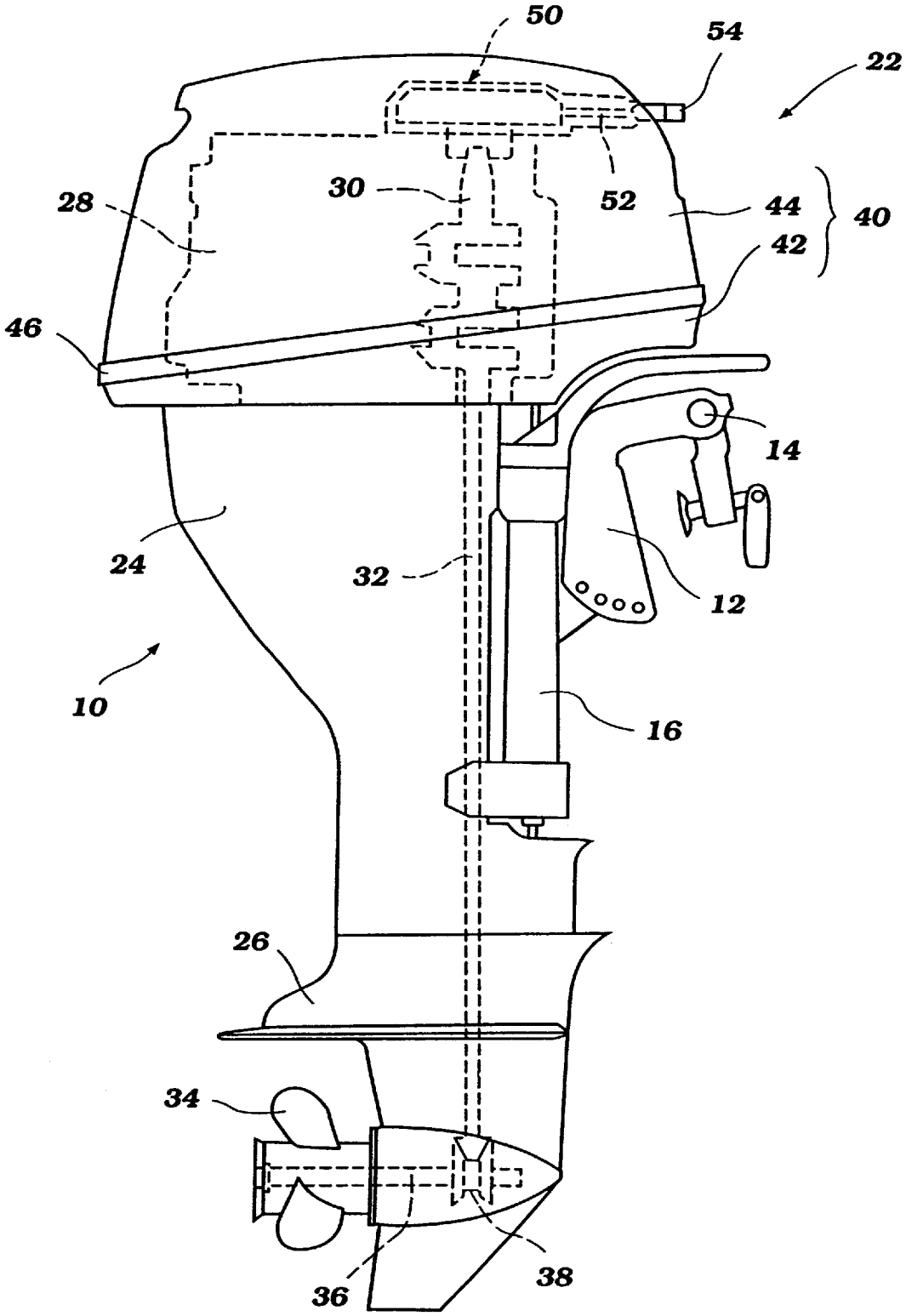
FIG. 1 is a side view of an exemplary outboard motor, and illustrates in broken line a drive train and components of an engine with a starter arrangement having features, aspects and advantages in accordance with the present invention.

With reference to FIG. 1, the environment of an outboard motor 10 serves to illustrate an exemplary starter arrangement. While the illustrated embodiment is employed in the environment of outboard motors, those of skill in the art will readily recognize that the present invention can also find utility in other internal combustion engines, such as those found in, for example but without limitation, snowmobiles, lawn mowers, motorcycles, and the like.

The motor 10 is attachable to a watercraft in a known manner. Specifically, the motor 10 has a clamping bracket 12. The motor 10 is removably affixed to a watercraft via the clamping bracket 12. The clamping bracket desirably has a tilt shaft 14 that allows the motor 10 to be tilted or trimmed in a known manner relative to the watercraft. The motor 10 also has a swivel bracket 16 that allows the motor 10 to be pivoted relative to the watercraft. The pivoting action allows an operator to steer the watercraft in a known manner.

The illustrated outboard motor 20 is generally comprised of a power head 22 from which a drive shaft housing 24 and lower unit 26 depend. The power head 22 is generally comprised of an internal combustion engine 28, which may be of any known type and for that reason has been illustrated only partially. Preferably, the engine is of the two-cylinder, two-cycle type.

The illustrated engine 28 has an output shaft 30, or crankshaft, which is journaled for rotation about a generally vertically extending axis. The output shaft is connected, in a known manner, to a flywheel 31 at a first end. The flywheel 31 may be provided with magnets for use in a flywheel magneto engine timing mechanism as is well known in the art.

The output shaft 30 is connected, at the other end, to a drive shaft 32 in a known manner. Desirably, the drive shaft 32 drivingly engages a propulsion unit, including a propeller 32, through a propeller shaft 34 and a transmission 36. Because each of these aforementioned components are believed to be well-known to those of skill in the art, they will not be discussed in detail.

The engine 28 is surrounded by a protective cowling assembly, which is indicated generally by the reference numeral 40 and which comprises a lower tray 42 and an upper cover 44 that is affixed to the lower tray 42 in a known manner. An elastomeric seal 46 encircles the lower periphery of the cover 44 and sealingly engages the tray 42 so as to provide a generally watertight enclosure for the engine 28.

Having described an exemplary environment of use for the present starter arrangement, the starter arrangement will now be described in detail, initially with continued reference to FIG. 1. In general, the starter arrangement comprises a recoil starter 50 having a starter rope 52 and a starter handle 54.

Figure 2:
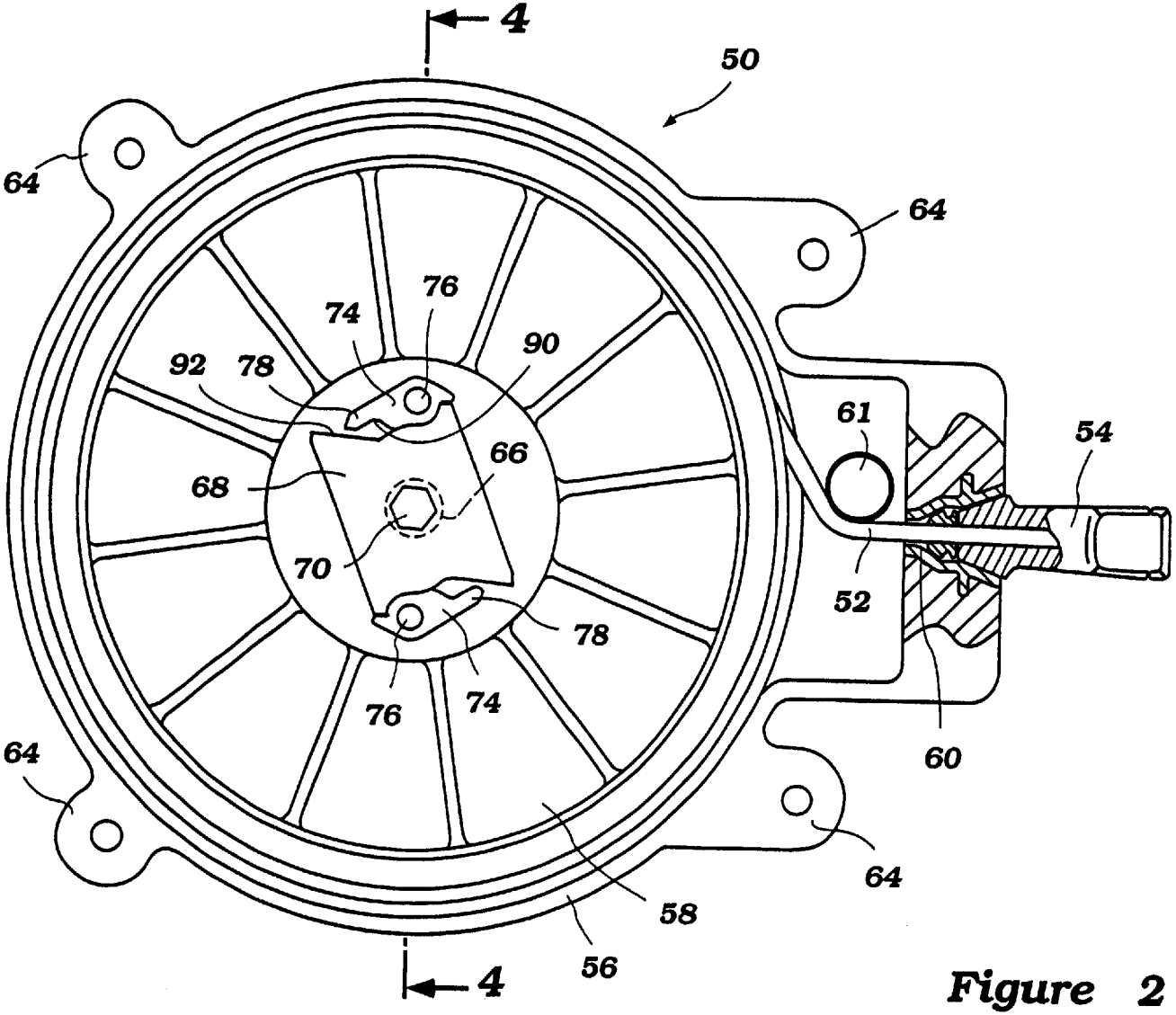
FIG. 2 is a partial sectional top view of the starter arrangement of FIG. 1.

With reference now to FIG. 2, a bottom view of a portion of the starter arrangement is illustrated. As shown, the starter handle 54 is connected to one end of the starter rope 52. The starter rope 52, or cord, extends into a starter cover 56, or shroud, through an opening 60 and is connected to a starter drum 58 in a known manner. The starter rope 52 is preferably wrapped around the starter drum 58. To this end, the starter drum 60 is provided with at least one groove 58 (see FIG. 3) into which the starter rope 52 is received and wrapped, after extending beyond the turnbuckle 61. Desirably, the starter rope 52 passes through the opening 60 and passes around a turnbuckle 61. The turnbuckle 61 is configured and arranged in a known manner to allow the starter rope 52 to wind on to, and unwind off of, the starter drum 58 without binding or overlapping, which may result in binding. As illustrated in FIG. 2, the starter rope 52 is wrapped about the starter drum 60 in a counterclockwise direction as viewed from the engine side of the starter drum 60.

The proximal end of the starter handle 54 (i.e., the end closest to the opening) is desirably complementary to the opening 60 such that the starter handle 54 effectively caps the opening 60 when the rope 52 is in a retracted position as illustrated in FIG. 2. This capping of the opening 60 reduces the likelihood of foreign debris entering a starter chamber defined between the starter cover 56 and the starter drum 58. Moreover, the capping of the opening 60 by the starter handle 54 results in a fixed stopping point for the starter rope 52 as it is rewound onto the starter drum 58.

Figure 3:
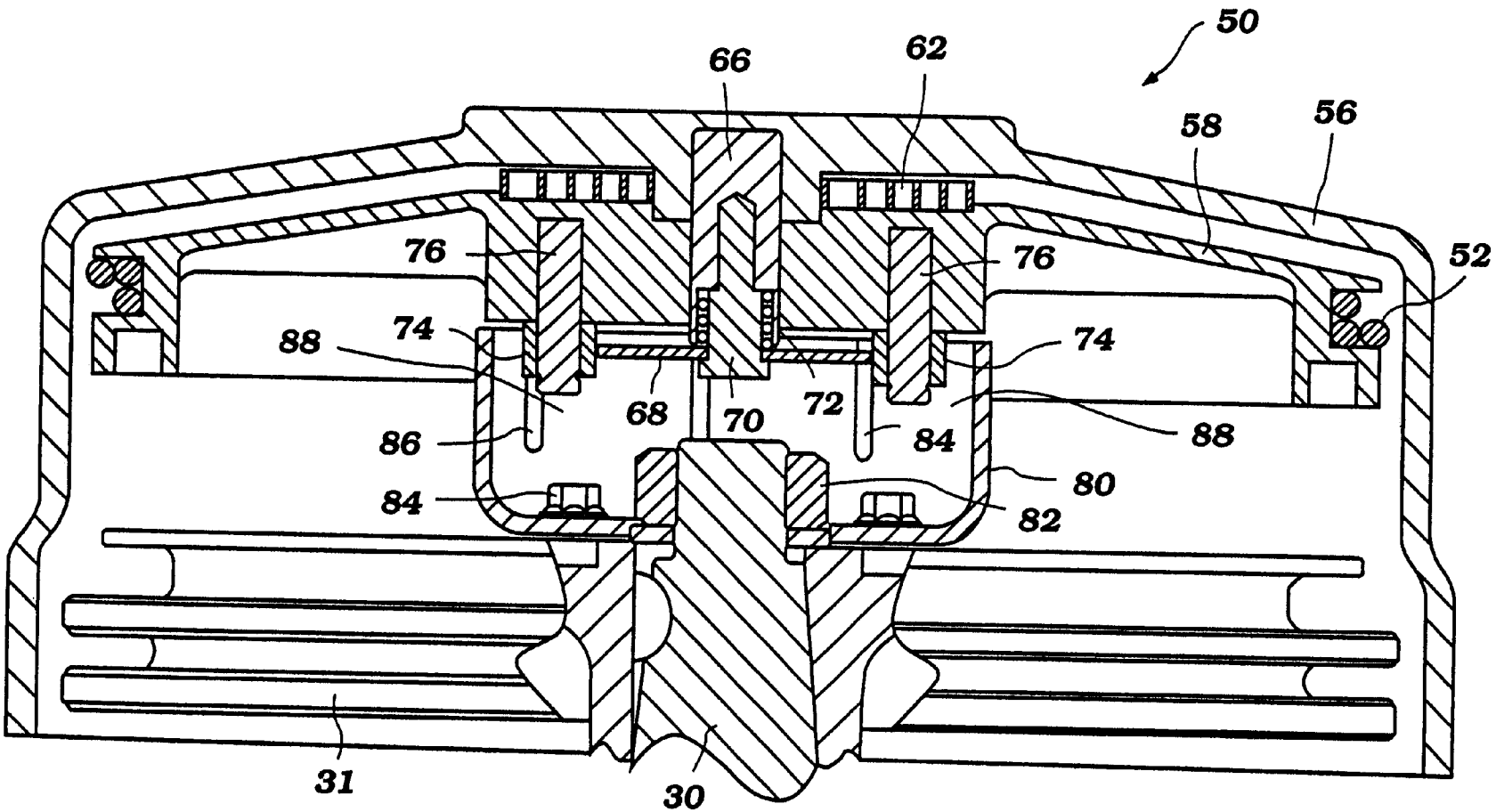
FIG. 3 is a sectional side view of the starter arrangement of FIG. 1.

To allow the starter drum 58 to return to a base position in which the starter rope 52 is wound onto the drum 58, a torsion spring 62, or other suitable biasing element, is attached to the starter drum 58. With reference to FIG. 3, the illustrated torsion spring 62 is captured between an inner surface of the starter cover 56 and an end of the starter drum 58 which faces the inner surface of the starter cover 56. While not illustrated, the torsion spring 62 is preferably attached at one end to the starter cover 56 and, at the other end, to the starter drum 58.

With reference again to FIG. 2, the starter cover 56 is secured to the engine in a fixed orientation through a plurality of mounting lugs 64. In the illustrated embodiment, the starter cover 56 has four mounting lugs 64; however, as will be recognized by those of skill in the art, the number of lugs 64 is not of critical importance so long as the cover is fixed relative to the engine such that the cover 56 does not rotate about the engine.

A starter drum support shaft 66 extends downward from the starter cover 56 and extends between the starter cover 56 and the starter drum 58. With reference now to FIG. 3, the starter drum support shaft 66 is shown embedded in the starter cover 56 and extending at least partially into a central through bore of the starter drum 58. As will be recognized by those of skill in the art, the support shaft 66 can also be integrally formed (i.e., unitary) with either the starter cover 56 or the starter drum 58 and adapted to rotate relative to the other. Unnecessary translational movement of the starter drum 58 relative to the starter cover 56 is reduced due to the support shaft 66 and a surrounding boss of the starter cover 56 which cooperates with a circular recess of the starter drum 58.

With continued reference to FIG. 3, a threaded fastener 70 connects a clutch drive member 68 to the support shaft 66. The threaded fastener may be any type of threaded fastener, or may be any other type of fastening arrangement that can adjustably secure the clutch drive member 68 to the starter drum 58. As illustrated, a biasing member 72, a compression spring in the illustrated embodiment, is secured between an upper face of the clutch drive member 68 and a lower surface of the support shaft 66. The biasing member 72 desirably exerts a force between the two members 66, 68. This force reduces the amplitude of vibratory forces that are transmitted among the members. In addition, this force both locates the members 66, 68 in a desired positioning relative other components, discussed below, and holds the members 66, 68 together to resist rotation of the clutch drive member 68 while still allowing a controlled rotation of the clutch drive member 68 relative to the starter cover 56. Specifically, the biasing member 72 allows the clutch drive member 68 to be frictionally attached to the starter drum 58 such that the clutch drive member 68 does not rotate freely with the drum 58, but is held against rotation until a sufficient rotational force is generated to cause the clutch drive member 68 to rotate with the drum 58. In this manner, the clutch drive member 68 rotates slightly with respect to the dog cams 74 in order to allow interaction between the complementary cam and drive surfaces 90, 92.

As mentioned above, the biasing member 72 positions the clutch drive member 68 relative to other components. In particular, the clutch drive member 68 desirably is vertically positioned relative to a dog cam 74. In the illustrated embodiment, the starter arrangement is provided with two dog cams 74; however, as will be recognized by those of skill in the art, the starter arrangement may have as few as one dog cam 74 or more than two dog cams 74.

With continued reference to FIG. 3, each dog cam 74 is pivotably secured to the starter drum 58. The dog cams 74 are secured substantially adjacent to the clutch drive member 68 by a shaft 76. The shaft 76 may be a pin, bushing or other type of bearing surface allowing easy rotation of the dog cam 74 relative to the starter drum 58. As illustrated, the shaft 76 has a knobbed or flared end that locks the dog cam 74 onto the shaft against gravity and secures its position relative to the starter drum 58.

With reference now to FIG. 2, the dog cams 74 are structured with a cam surface 90 directed toward a complementary drive surface 92 of the clutch drive member 68. The cam surface 90 terminates in an engaging tip portion 78. The engaging tip portion 78 of the cam surface 90 is designed to selectively engage a starter pulley 80, or contact an internal surface thereof, during starting.

In the illustrated embodiment, the starter pulley 80 is affixed to both the end of the output shaft 30 and the flywheel 31. A nut 82 attaches the starter pulley 80 to the output shaft 30. A plurality of threaded fasteners 84, such at least two bolts arranged around a bolt circle, secure the starter pulley 80 to the flywheel 31. Thus, any rotation of the starter pulley 80 is transmitted to the flywheel 31, and ultimately to the output shaft 30. Moreover, any rotation of the output shaft 30 is transmitted to the flywheel 31, and ultimately to the starter pulley 80.

As mentioned above, the dog cams 74 are adapted to engage the starter pulley 80 during starting. Particularly, as illustrated in FIGS. 3 and 4–6, the engaging tip portions 78 are brought into engagement with any of a plurality of engaging grooves or slots 86 defined on an upper portion of a ring structure of the starter pulley 80. The ring structure is segmented (i.e., it is defined by a plurality of slots 86 separated by a plurality of web portions 88 arranged to form a circle). In particular, opposing side faces (i.e., the sides which reflect the thickness of the web portions 88) of the web portions 88 define the slots 86. The structure of the starter arrangement as described thus far is considered conventional and, as such, any details omitted are deemed to be within the knowledge of one of ordinary skill in the relevant art.

Figure 4:
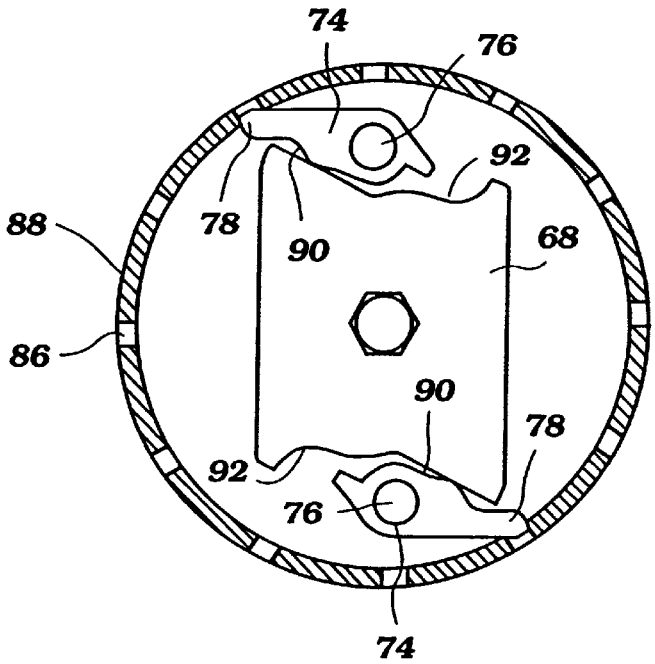
FIG. 4 is a partial sectional bottom view of the starter arrangement of FIG. 3 taken through the line 4—4, illustrating a pair of dog cams and a clutch drive member.

With reference now to FIGS. 2, and 4–6, the novel structure of the dog cam 74 will be described in detail with reference to a single dog cam 74. This description applies equally to all other numbers of dog cams. As illustrated in FIG. 4, the dog cam 74 has a cam surface 90 which is in sliding contact with a drive surface 92 of the clutch drive member 68. The cam surface 90 and the drive surface 92 cooperate to pivot the dog cam 74 about shaft 76.

The cam surface 90 extends toward the tip portion 78 of the dog cam 74 in a desirable configuration of projections and valleys that correspond to the configuration of projections and valleys on the clutch drive mechanism 68. These cooperating projections and valleys result in the urging of the cam dogs in a counterclockwise direction about the shaft 76, into an extended position, when the starter drum 58 is rotated and in the urging of the dogs 74 back to their initial position when the rotation of the starter drum 58 has ceased. With reference to FIG. 4, the cam surface 90 actually engages the side wall of the slots 86 in order to drive the starter pulley 80.

The tip portion 78 of the dog cam 74, in its extended position, terminates in a ride surface 94. In the illustrated embodiment, the ride surface 94 is approximately normal to the distal extremity 96 of the cam surface 90 side of the dog cam 74 at their juncture. The ride surface 94 then provides a surface that is substantially tangential to the inner surface (i.e., the surface corresponding to an inner radius) of the web portions 88 of the drive pulley 80 when the dog cam 74 is extended. Thus, the ride surface 94 will contact the inner surface in two locations simultaneously. The ride surface 94 has a smaller length than the width of the slot 86 into which the ride surface 94 can slide.

Figure 6:
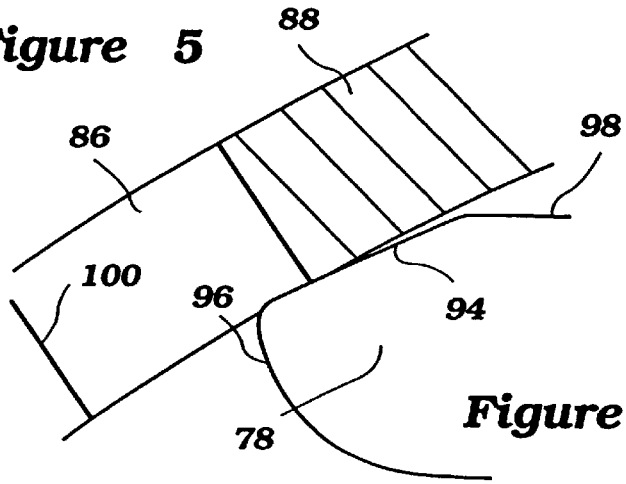
FIG. 6 is a further enlarged view of the starter arrangement of FIG. 4, illustrating a contact surface between a single dog cam and a starter pulley.
Figure 7:
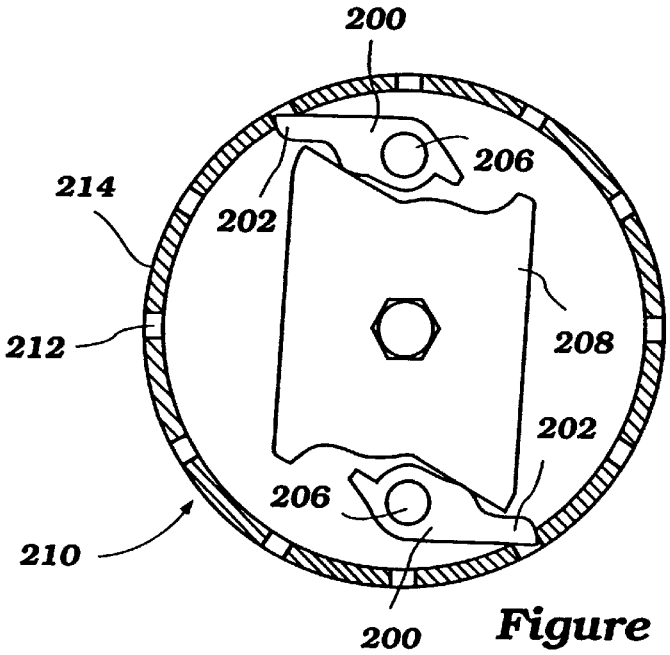
FIG. 7 is a partially sectioned bottom view of a prior starter arrangement, illustrating an exemplary pair of dog cams and a clutch drive member.
Figure 8:
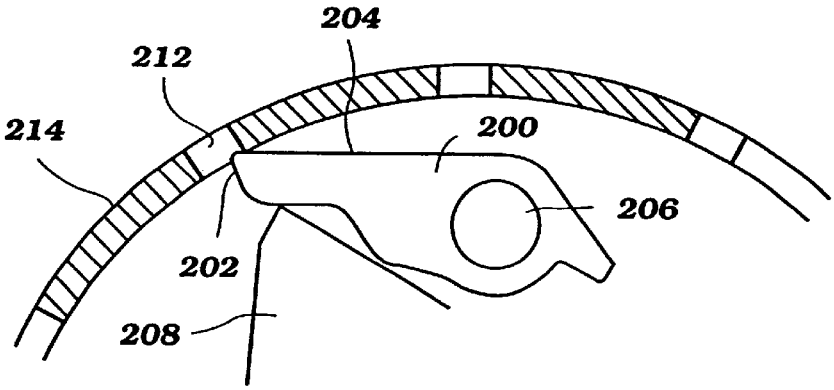
FIG. 8 is an enlarged view of the starter arrangement of FIG. 7, illustrating a single dog cam and the clutch drive member.
Figure 9:
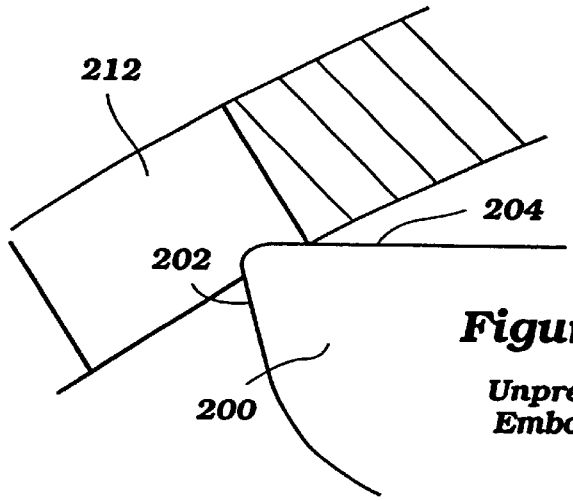
FIG. 9 is a further enlarged view of the starter arrangement of FIG. 7, illustrating a contact surface between a single dog cam and a starter pulley.

Desirably, the ride surface 94 extends at a slight angle, as illustrated in FIG. 6, to the webbing portion 88 such that the apex defined by the distal extremity 96 and the ride surface 94 can extend very slightly into the slot 86. This slight intervention across a plane defined at the innermost surface of the webbing portions 88 defining the slot allows the distal extremity 96 to catch on a wall 100, which defines the slot 88, such that the dog cams 74 can become engaged with the starter pulley 80. While the slight intervention enables the engagement of the dog cams 74 with the starter pulley 80, the slight intervention ensures that, upon starting of the engine, the dog cams 74 are not battered by the starter pulley 80 as the starter pulley reverses the relative rotations of the starter pulley 80 and the starter drum 58, as discussed above.

In the illustrated embodiment, the ride surface 94 is interposed between the cam surface 90 and an external surface 98. As illustrated, the ride surface 94 forms a discontinuity with both the external surface 98 and the cam surface 90, such that the ride surface is skewed relative to both. The external surface extends back around the dog cam 74 to the cam surface 90. Thus, the ride surface 94 defines a surface which can glide over an inner surface of the starter pulley 80 without dropping deeply into the slots 86 defined in the starter pulley 80.

Figure 5:
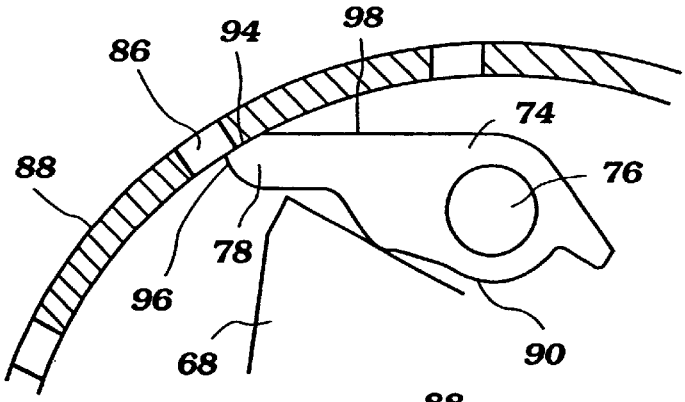
FIG. 5 is an enlarged view of the starter arrangement of FIG. 4, illustrating a single dog cam and the clutch drive member.

In use, as the start cord 52 is pulled through the opening 60, the attached starter drum 58 spins in a clockwise direction (when viewed from the bottom). As the starter drum 58 spins, the attached dog cams 74 are rotated about a center axis, which extends through the center of the support shaft 66. The rotation of the dog cams 74 results in the dog cams 74 sliding along the drive surface 92 of the clutch drive member 68. The cooperation of the cam surface 90 and the drive surface 92 results in a pivoting of the dog cams 74 about the shaft 76. The pivoting of the dog cams urges the engaging tip portion 78 against the webbing portions 88 of the starter pulley 80. Once the engaging tip portion 78 encounters a slot 86, the tip portion 78 will be urged into engagement with the slot 86 as illustrated in FIGS. 4–6.

Once the tip portions 78 and the slots 86 are engaged, the starter pulley 80 is rotated with the starter drum 58. Because the starter pulley 80 is coupled to the flywheel 31 and, therefore, the output shaft, the rotation of the starter pulley 80 results in a corresponding rotation of the output shaft 30. The rotation of the output shaft 30 can create sufficient compression of the engine to initiate ignition of the internal combustion engine. Once ignited under sufficient compression, the engine will begin to run under its own power, as is well known to those of skill in the art.

Once the engine has fired and begins operation under its own power, the output shaft 30 and the flywheel 31 are rotated without the assistance of the starter assembly. Accordingly, the starter pulley 80 is also rotated without the assistance of the starter drum 58. Additionally, the revolution speed of the operating engine is typically faster than the revolution speed of the starter drum when under the influence of the starter rope 52. Thus, the starter pulley 80 rapidly overtakes the starter drum 58 and the two become disengaged.

Due to the inventive configuration of the ride surface 94, the dog cam 74 has a reduced chatter. Specifically, the ride surface 94 creates a low relief impact region which is significantly less substantial than the peaked end of the ramping surface 204 of the prior designs. Because the ride surface 94 does not extend as deeply into the slots 86 of the drive pulley 80 as the ramping surface of the prior design, the deflection, vibration and associated noise are significantly reduced. Thus, the creation of a low profile, low angle contact surface, among other elements, significantly improves the performance of the disclosed invention.

Although this invention has been described in terms of a certain embodiment, other embodiments apparent to those of ordinary skill in the art also are within the scope of this invention. Thus, various changes and modifications may be made without departing from the spirit and scope of the invention. Accordingly, the scope of the invention is intended to be defined only by the claims that follow.

What is claimed is:

1. A recoil starter arrangement for an internal combustion engine, the recoil starter arrangement comprising a starter drum, a dog cam attached to the starter drum by a shaft, a starter pulley having a substantially smooth internal surface and an engagement groove defined by a pair of opposing surfaces, the dog cam having a cam surface and an external surface, the dog cam also having a ride surface which is discontinuous from both the cam surface and the external surface and which is interposed therebetween, the dog cam configured to contact the pair of opposing surfaces defining the engagement groove when the dog cam engaged with the engagement groove, and the ride surface being contoured to complement the internal surface such that the dog cam can substantially glide over the engaging grooves when the dog cam is not in contact with the pair of opposing surfaces.

2. The recoil starter arrangement of claim 1, wherein the ride surface of the dog cam simultaneously contacts the substantially smooth internal surface of the starter pulley in at least two locations.

3. The recoil starter arrangement of claim 2, wherein the starter pulley further comprises more than one engagement groove.

4. The recoil starter arrangement of claim 1, wherein the dog cam contacts the pair of surfaces defining the engagement groove with the external surface and the cam surface.

5. The recoil starter arrangement of claim 1, wherein the ride surface is configured to not contact the pair of surfaces defining the engagement groove when the dog cam contacts the pair of surfaces.

6. A recoil starter arrangement for an internal combustion engine, the recoil starter arrangement comprising a starter pulley having a segmented inner surface defined at an inner radius and an outer surface defined at an outer radius, the segmented inner surface having slots defined therein, a dog cam member selectively contacting the segmented inner surface and being unbiased by any spring member, the dog cam member having a ride surface which is generally tangential to the inner radius while the dog cam member is in contact with the segmented inner surface and the dog cam member selectively engaging with the starter pulley at a location defined at an intermediate radius while being disposed within the outer radius, the intermediate radius being larger than the inner radius and smaller than the outer radius.

7. The recoil starter arrangement of claim 6, wherein the dog cam member further comprises a cam surface and an external surface, wherein the ride surface is positioned between the cam surface and the external surface.

8. The recoil starter arrangement of claim 6, wherein the ride surface of the dog cam simultaneously contacts the segmented inner surface of the starter pulley in at least two locations.

9. The recoil starter arrangement of claim 8, wherein the cam surface of the dog cam is engageable with the slots defined in the starter pulley.

10. An internal combustion engine having a recoil starting arrangement, the engine comprising an output shaft, a flywheel attached to the output shaft, a starter pulley operably connected to the flywheel, the starter pulley having a plurality of engagement grooves defined by generally parallel walls that face one another and the groves being separated by arcuate web portions, a dog cam pivotably attached to a starter drum by a pivot, the pivot being located such that forces transmitted between the dog cam and the starter pulley that do not produce substantial torques on the dog cam, the dog cam also having an engaging tip portion, the engaging tip portion selectively engageable with at least one of the plurality of engagement grooves of the starter pulley when the starter drum is rotated in a first direction relative to the starter pulley, the engaging tip portion contacting the web portions on both sides of said engagement groove when engaged with the engagement groove, and the engaging tip portion being contoured to complement the web portions such that the engaging tip portion can substantially glide over the engaging grooves when the starter pulley rotates in a second direction relative to the starter drum whereby a noise level associated with the starter arrangement following engine ignition can be reduced.

11. The internal combustion engine of claim 10, further comprising a dog cam clutching member, the dog cam clutching member having a drive surface, the drive surface configured to drive the dog cam between a first position and a second position, the engaging tip portion of the dog cam being disengaged from the starter pulley when the dog cam is in the first position and the engaging tip portion of the dog cam being engaged with the starter pulley when the dog cam is in the second position.

12. The internal combustion engine of claim 10, further comprising a shroud to which the starter drum is secured for rotation, a pull cord attached to the starter drum and extending through the shroud, and a torsion spring positioned between the shroud and the starter drum, the torsion spring building energy as the starter drum is rotated when the pull cord is withdrawn from shroud and restoring the energy to the starter drum when the pull cord is released.

13. The internal combustion engine of claim 12, wherein the starter drum is engaged with the starter pulley while the torsion spring builds energy and is disengaged from the starter pulley while the torsion spring restores energy to the starter drum.

14. The internal combustion engine of claim 13, wherein the engaging tip portion rides over the engaging grooves on a riding surface while the torsion spring restores energy to the starter drum.

15. The internal combustion engine of claim 14, wherein the riding surface of the engaging tip portion does not form an acute angle with the starter pulley web portions.

16. A recoil starter arrangement for an internal combustion engine, the recoil starter arrangement comprising a starter pulley having a segmented inner surface defined at an inner radius, the segmented inner surface having slots defined therein, a dog cam member selectively contacting the segmented inner surface and being unbiased by any spring member, the dog cam member having a ride surface which is generally tangential to the inner radius while the dog cam member is in contact with the segmented inner surface, the dog cam member selectively engaging with the starter pulley at a location defined at an outer radius, the outer radius being larger than the inner radius when the dog cam member is engaged with the starter pulley, and the ride surface of the dog cam simultaneously contacting the segmented inner surface of the starter pulley in at least two locations when the dog cam member is disengaged from the starter pulley.

17. The recoil starter arrangement of claim 16, wherein the cam surface of the dog cam member is engageable with the slots defined in the starter pulley.

* * * * *

UNITED STATES PATENT AND TRADEMARK OFFICE

CERTIFICATE OF CORRECTION

PATENT NO. : 6,363,901 B1
DATED : April 2, 2002
INVENTOR(S) : Watanabe et al.

It is certified that error appears in the above-identified patent and that said Letters Patent is hereby corrected as shown below:

Column 8,
Line 35, "groves" should be -- grooves --

Signed and Sealed this

Eighth Day of April, 2003

JAMES E. ROGAN
*Director of the United States Patent and Trademark Office*